US007841397B2

(12) United States Patent
Hamilton

(10) Patent No.: US 7,841,397 B2
(45) Date of Patent: Nov. 30, 2010

(54) STRADDLE PACKER AND METHOD FOR USING THE SAME IN A WELL BORE

(75) Inventor: Brendon Hamilton, Medicine Hat (CA)

(73) Assignee: Calfrac Well Services Ltd., Calgary, Alberta (CA)

( * ) Notice: Subject to any disclaimer, the term of this patent is extended or adjusted under 35 U.S.C. 154(b) by 0 days.

(21) Appl. No.: 10/880,600

(22) Filed: Jul. 1, 2004

(65) Prior Publication Data

US 2006/0000620 A1 Jan. 5, 2006

(30) Foreign Application Priority Data

Jun. 30, 2004 (CA) ..... 2472824

(51) Int. Cl.
*E21B 33/126* (2006.01)
*E21B 43/26* (2006.01)

(52) U.S. Cl. ..... 166/191; 166/121; 166/127; 166/177.5; 166/308.1; 166/387

(58) Field of Classification Search ..... 166/312, 166/387, 380, 191, 121, 127, 181, 177.5, 166/308.1
See application file for complete search history.

(56) References Cited

U.S. PATENT DOCUMENTS

| | | | | | |
|---|---|---|---|---|---|
| 2,554,005 | A * | 5/1951 | Bodine, Jr. | ..... | 175/55 |
| 3,659,648 | A * | 5/1972 | Cobbs | ..... | 166/120 |
| 4,192,375 | A * | 3/1980 | Maly et al. | ..... | 166/51 |
| 4,714,117 | A * | 12/1987 | Dech | ..... | 166/380 |
| 5,343,956 | A * | 9/1994 | Coronado | ..... | 166/387 |
| 5,894,888 | A * | 4/1999 | Wiemers et al. | ..... | 166/250.1 |
| 6,655,461 | B2 * | 12/2003 | Eslinger et al. | ..... | 166/305.1 |
| 2004/0084187 | A1 * | 5/2004 | Costley et al. | ..... | 166/312 |

* cited by examiner

*Primary Examiner*—Daniel P Stephenson
*Assistant Examiner*—Brad Harcourt
(74) *Attorney, Agent, or Firm*—Welsh Flaxman & Gitler LLC

(57) ABSTRACT

A tool for use in the treatment of a formation penetrated by a well bore. The tool comprises a tubular core having at least one opening therein for the discharge of pressurized fluid from within the core, first and second axially spaced apart seals disposed on the core for seals between the core and the well bore, the opening in the core being located between the first and second seals, and a third seal disposed downhole relative to the first and second seals for sealing between the tool and the well bore, the third seal protecting the first and second seals from pressure in the well bore below the tool.

3 Claims, 3 Drawing Sheets

STRADDLE PACKER AND METHOD FOR USING THE SAME IN A WELL BORE

FIELD OF THE INVENTION

The present invention relates to the enhancement of an isolation tool usable when treating multiple zones in a well bore, and more particularly to an improved straddle packer.

BACKGROUND OF THE INVENTION

Sand fracturing through coiled tubing and through snubbing units has allowed the development of new trends in well stimulation. The ability to perforate multiple zones in a single well and then fracture each zone independently has increased access to more potential reserves.

The fracturing program starts at the lowest zone in the well bore. The term fracturing refers to the use of fluids and proppants utilized for injection at high pressure into oil or gas wells, to fracture the geological formations surrounding the well, and thereby increasing their productivity. This permits more efficient flow of hydrocarbons and accelerates access to the reserves.

The purpose of the fracturing fluid is two fold: first to transmit energy generated at surface down the well bore to hydraulically create a fracture within reservoir rock, and secondly, to transport a proppant agent (usually sand) from surface to the reservoir to ensure conductivity generated by the fracture is preserved.

A hydraulic fracturing treatment typically consists of three main stages. Initially a "Pad" stage is pumped to initiate the fracture and create width for the stages to follow. The fluid pumped through this initial stage consists of the fracturing fluid without proppants. After a sufficient volume of Pad has been pumped, proppant is added to the fracturing fluid to form the "Slurry" stage. Concentrations of the proppant (sand, resin-coated sand, or ceramics) typically are kept low at the beginning and slowly ramped up to maximum values, which vary as a function of depth, fracturing pressures and reservoir type. An optimization process utilizing numerical and analytical simulation models can be used to determine the amount of proppant that is pumped, as is known in the art. Once the appropriate volume of proppant has been mixed by the blender and pumped down the well bore, a "Flush" stage, consisting of more fracturing fluid, is used to displace the slurry stage to the perforations.

Treatment design is based on several parameters that include, but are not limited to, reservoir permeability, pressure, depth, temperature and reservoir fluid type. Fracture fluid viscosity, down-hole injection rates, proppant size and type, proppant volume and concentrations are all important aspects of the final stimulation program. As is well known in the art, engineering modelling tools, together with previous field experience gained in each area, are used in a combined approach to formulate the best possible stimulation design for the reservoir.

A desirable feature in a fracturing fluid is variable viscosity. That is, fluids will frequently contain additives that can be selectively added, chemically or physically, to increase or decrease the viscosity of the fluid. The reason a high viscosity is desired is for the transport of proppant down the well bore and into the fracture, such as sand granules into a fractured formation to prevent the fracture from completely closing in the formation. The proppant ensures that the conductivity of the fracture is maintained. Afterwards, it is desirable to lower the viscosity of the fluid, so that it will flow out of the fracture into the well bore and to surface, allowing the flow of hydrocarbons to begin or resume.

Prior to commencement of the fracturing treatment, the straddle packer is placed across the lowest perforated interval and that zone is then fractured. Generally, a straddle packer comprises a pair of vertically spaced apart seals mounted on a tubular barrel that has an orifice to allow the fracturing fluid pumped through the barrel's interior to escape into the annulus between the barrel and the well casing. The pressure of the fluid expands the seals into sealing contact with the casing's inner wall so that the fluid then diverts itself through the perforations in the casing into the targeted formation. The seals are set sufficiently far apart to straddle the width of the zone to be fractured.

After treatment of the lowest zone, the tool is moved up the casing to the next perforated interval and this zone is then fractured. This operation is repeated for all the perforated intervals.

Particularly if the fracturing fluids have been energized, that is, co-mingled with a pressurized gas such as $C0_2$ or $N_2$, it becomes extremely important to complete all the zones quickly and then allow the well to begin flowing back from the co-mingled zones for recovery of injected fluids.

Current isolation tools work effectively at isolating the zone and fracturing once down the well bore. However, when fracturing multiple zones in the well bore, and when the pressure of a previously treated lower zone exceeds the resistance of the tool's lower sealing member, fluid with sand will flow past the lower sealing member, collapsing it, and possibly even flowing into the tool body. This can prevent the tool from moving up the well bore, seating at the next interval or sealing the next set of perforations. These consequences can all create serious job problems and/or failures.

SUMMARY OF THE INVENTION

In view of the foregoing, there is a need for a device of simple design allowing multiple zones along the well bore to be securely sealed and isolated from outside sand and fluids.

In a preferred embodiment of the present invention, the present tool is modified by adding a third sealing member below the lower sealing member. This third seal can be of similar material to the upper and lower seals and can be manufactured from rubber, urethane or any other similar material as will be apparent to those skilled in the art. The purpose of the third seal is to prevent fluid and sand from below the tool from entering the zone being isolated by the straddle packer.

According to the present invention then, there is provided a tool for use in the treatment of a formation penetrated by a well bore, the tool comprising a tubular core having at least one opening therein for the discharge of pressurized fluid from within said core; first and second axially spaced apart sealing members disposed on said core for sealing between said core and said well bore, said at least one opening in said core being located between said first and second sealing members; and a third sealing member disposed downhole relative to said first and second sealing members for sealing between said tool and said well bore.

According to a further aspect of the present invention, there is also provided a straddle packer for use to isolate a segment of a well bore penetrating a formation to be treated with a pressurized fluid, comprising a central tubular member having at least one orifice formed therein for the discharge of said pressurized fluid; a first seal member located above said orifice for fluid sealing between said central member and said well bore; a second seal located below said orifice for fluid sealing between said central member and said well bore; and a third seal located below said second seal for fluid sealing between said tubular member and said well bore, said third seal acting to isolate said second seal from pressure in said well bore below said straddle packer.

According to yet another aspect of the present invention, there is also provided a method for sequentially isolating segments of a well bore penetrating formations to be treated by a pressurized fluid, comprising the steps of isolating a first segment of said well bore using a tool comprising a tubular core having at least one opening therein for the discharge of pressurized fluid from within said core; first and second axially spaced apart sealing members disposed on said core for sealing between said core and said well bore, said at least one opening in said core being located between said first and second sealing members; and a third sealing member disposed downhole relative to said first and second sealing members for sealing between said tool and said well bore; injecting pressurized fluid through said tool and said opening in the core thereof, said fluid entering into the formation for the treatment thereof through perforations in said well bore, said first and second sealing members containing said pressurized fluid against escape; moving said tool upwardly in said well bore to isolate the next segment of said well bore and again injecting said pressurized fluid into a formation adjacent said next segment of said well bore; and using said third sealing member to isolate said first and second sealing members from pressure acting from below said tool.

According to still another aspect of the present invention, there is also provided a method for isolating a segment of a well bore penetrating a formation to be treated by a pressurized fluid, comprising the steps of isolating said segment of said well bore using a tool comprising a tubular core having at least one opening therein for the discharge of pressurized fluid from within said core; first and second axially spaced apart sealing members disposed on said core for sealing between said core and said well bore, said at least one opening in said core being located between said first and second sealing members; and a third sealing member disposed downhole relative to said first and second sealing members for sealing between said tool and said well bore; injecting pressurized fluid through said tool and said opening in the core thereof, said fluid entering into the formation for the treatment thereof through perforations in said well bore, said first and second sealing members containing said pressurized fluid against escape; and using said third sealing member to isolate said first and second sealing members from pressure acting from below said tool.

BRIEF DESCRIPTION OF THE DRAWINGS

Preferred embodiments of the present invention will now be described in greater detail and will be better understood when read in conjunction with the following drawings in which.

DETAILED DESCRIPTION OF THE PREFERRED EMBODIMENTS

Figure 1:
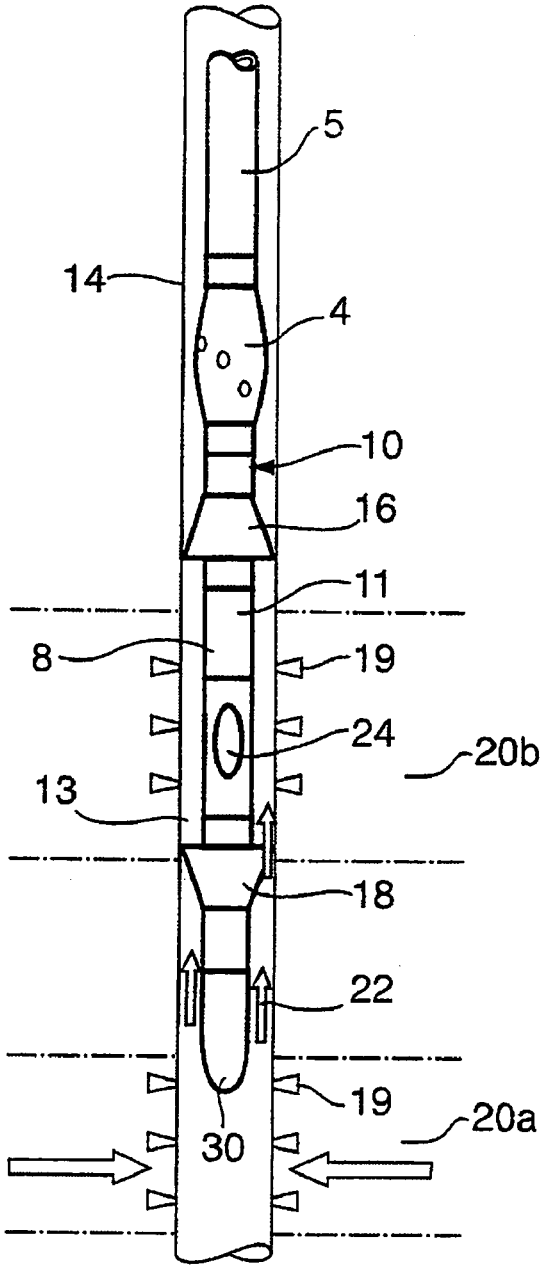
FIG. 1 PRIOR ART
FIG. 1 is a side elevational view of a known straddle packer having a pair of upper and lower sealing members.

With reference to FIG. 1, a conventional isolation tool in the nature of a straddle packer 10 is shown. The tool is suspended down-hole by a length of coiled tubing 5 or at the end of snubbing unit (not shown) and is connected to the tubing by means of a coiled tubing connector and a disconnect shown collectively at 4. Connectors and disconnects are well known in the art and will not be described here in detail. Coiled tubing is not internally threaded in the manner of jointed pipe and hence specialized connectors are needed to join the tubing to down-hole tools and assemblies. Disconnects are operable from the surface to uncouple the tubing from the tool in the event the tool becomes stuck in the well bore. Should that happen, the tubing, which is of limited tensile strength, is removed and either a fishing tool at the end of stronger tubular stock is lowered into the well to grapple the stuck device, or a type of ram is used to push the tool to the well bottom. It will be understood that although the present tool is advantageously used with coiled tubing, it can also be used with conventional threaded pipe. As well, although the tool's primary use will likely be in respect of fracturing operations, it can be used in any instance in which fluids are to be injected for other forms of treatments such as acidizing.

Isolation tool 10 itself consists of a tubular core 11 connectable at its upper end to coiled tubing 5 to be in fluid communication therewith for the flow of fracturing fluid and proppant through the tubing, into the core and then into the annulus 13 between core 11 and well casing 14 through an orifice 24. For purposes of this description, core 11 comprises at least the portion of the tool beneath the coiled tubing 5 that includes orifice 24 but more broadly can also include the entire length of the tool beneath disconnect 4 which might variably include various subs, housings, cross-overs, extensions and even bullnose 30 located at the tool's lowermost end which facilitates insertion into the well bore. As used herein, the term "tubular" means that fluid communication exists at least between coiled tubing 5 and orifice 24. The remaining portions of the core can be either tubular or solid as the user elects or prefers.

Sealing between core 11 and casing 14 is provided by a pair of vertically spaced apart seals including an upper seal 16 and a lower seal 18. Numerous types of seals are known in the art but perhaps most commonly, the seals are frustoconically shaped cups as shown in the drawings.

Figure 4:
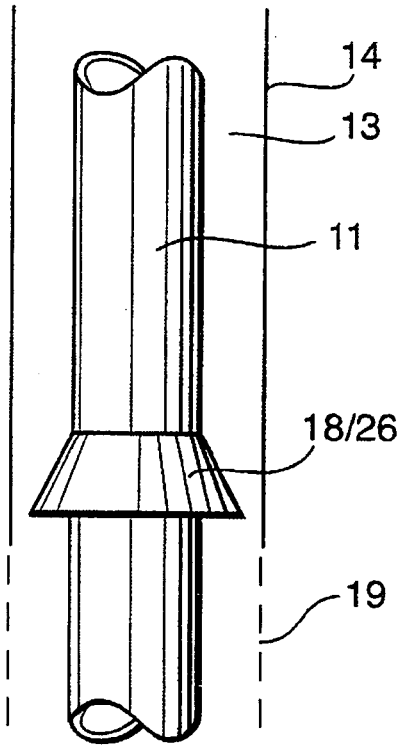
FIG. 4 is a side elevational view of a sealing member forming part of the tool of FIG. 2 when not exposed to pressure.
Figure 5:
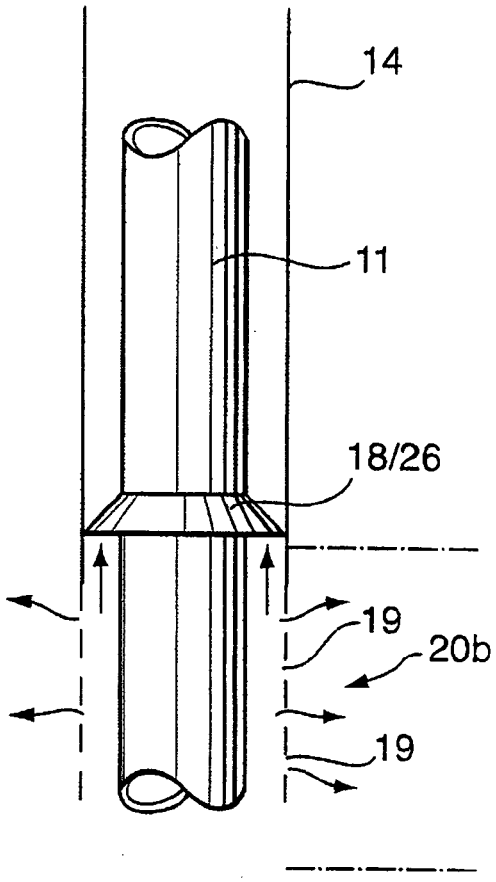
FIG. 5 is a side elevational view of the sealing member of FIG. 4 exposed to pressure.

The cups are mounted onto core 11 in a known fashion so that their inner flared ends face one another. Prior to the introduction of pressurized fluid, the seals are sized to only partially occupy annulus 13 as shown in FIG. 4. When fracturing fluid enters the annulus, the cups react by expanding into sealing contact with the casing walls as shown most clearly in FIG. 5. Fluid flow is then diverted through perforations 19 in the casing wall and enters formation 20*b* to induce fracturing.

The distance between seals 16 and 18 can be selected by choosing the length of core 11 or by segmenting the core using as many or as few tubular subs 8 as required for the desired degree of separation.

After formation 20*a* has been treated, tool 10 is then moved into position opposite the next set of perforations at formation 20*b*. Formation 20*a*, having already been treated, is now releasing formation pressure, fracturing fluid (often energized) and sand into the casing, the collective pressure of which now acts in the direction of arrows 22 against lower seal 18. This pressure can exceed the pressure between seals 16 and 18, causing seal 18 to fail and allowing down-hole fluid and sand to bypass the cup with potentially serious consequences.

Figure 2:
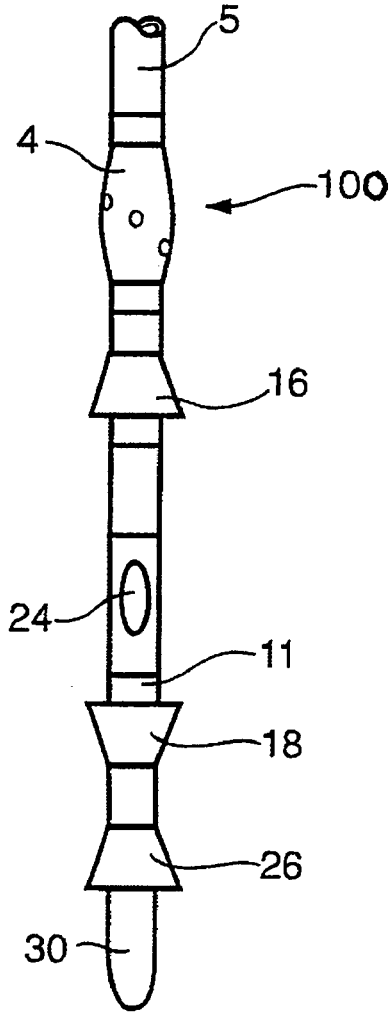
FIG. 2 is a side elevational view of an isolation tool modified in accordance with one aspect of the present invention.
Figure 3:
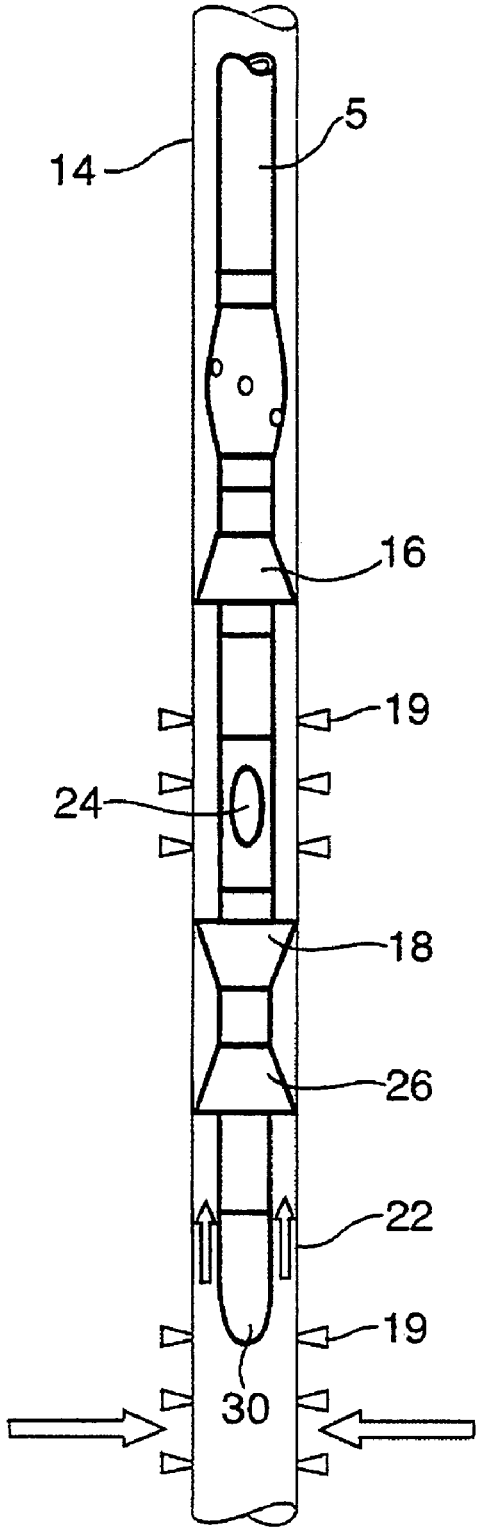
FIG. 3 is a side elevational view of the tool of FIG. 2 deployed in the well bore.

To prevent this, the applicant has found a simple yet entirely effective solution as shown most clearly in FIGS. 2 and 3 wherein like numerals have been used to identify like elements.

As will be seen, tool 100 of the present invention has been modified to include a third seal 26 located beneath lower seal 18. In a preferred embodiment constructed by the applicant, seal 26 is again a frustoconical cup with its wider end oriented down-hole so that trapped pressure from a previously treated zone acting in the direction of arrows 22 causes the cup to seal against the casing. This effectively prevents fluid and sand from reaching the upper part of the tool including lower seal 18.

The addition of this third seal allows for a significant improvement in tool performance when stimulating multiple zones in the least amount of time, and that allows the well to flow back as quickly as possible with fewer possible complications.

The above-described embodiments of the present invention are meant to be illustrative of preferred embodiments of the present invention and are not intended to limit the scope of the present invention. Various modifications, which would be readily apparent to one skilled in the art, are intended to be within the scope of the present invention. The only limitations to the scope of the present invention are set out in the following appended claims.

I claim:

1. A method for sequentially isolating segments of a well bore penetrating formations to be treated by a pressurized fluid, comprising the steps of:

isolating a first segment of said well bore using a tool comprising a tubular core having at least one opening therein for the discharge of pressurized fluid from within said core; first and second axially spaced apart sealing members disposed on said core for sealing between said core and said well bore, said at least one opening in said core being located between said first and second sealing members; and a third sealing member disposed downhole in a non-contiguous relationship at a predetermined non-zero distance relative to said first and second sealing members for sealing between said tool and said well bore, said first, second and third sealing members being connected to said core to maintain a fixed spacing therebetween;

injecting pressurized fluid through said tool and said opening in the core thereof, said fluid entering into the formation for the treatment thereof through perforations in said well bore, said first and second sealing members being expandable in response to the pressure of said pressurized fluid discharged from said opening to move into fluid sealing contact with said well bore to contain said pressurized fluid against escape;

stopping the injection of said pressurized fluid whereupon said first and second sealing members contract into a non-sealing position;

moving said tool upwardly in said well bore to isolate the next segment of said well bore and again injecting said pressurized fluid into a formation adjacent said next segment of said well bore; and said third sealing member being expanded into fluid sealing contact with said well bore in response to pressure in said well bore below said tool, thereby isolating said first and second sealing members from pressure acting from below said tool during treatment of said formation and when said tool is moved upwardly in said well bore.

2. The method of claim 1 wherein said pressurized fluid is a fracturing fluid for hydraulically fracturing said formation.

3. A method for isolating a segment of a well bore penetrating a formation to be treated by a pressurized fluid, comprising the steps of:

isolating said segment of said well bore using a tool comprising a tubular core having at least one opening therein for the discharge of pressurized fluid from within said core; first and second axially spaced apart sealing members disposed on said core for sealing between said core and said well bore, said at least one opening in said core being located between said first and second sealing members; and a third sealing member disposed downhole in a non-contiguous relationship at a predetermined non-zero distance relative to said first and second sealing members for sealing between said tool and said well bore, said first, second and third sealing members being connected to said core to maintain a fixed spacing therebetween;

injecting pressurized fluid through said tool and said opening in the core thereof, said fluid entering into the formation for the treatment thereof through perforations in said well bore, said first and second sealing members being expandable in response to the pressure of said pressurized fluid discharged from said at least one opening to move into fluid sealing contact with said well bore to contain said pressurized fluid against escape and retractable into a non-sealing position when the injection of said pressurized fluid is stopped to allow said tool to be moved opposite another segment of said well bore to be isolated and treated; and said third sealing member being expanded into fluid sealing contact with said well bore in response to pressure in said well bore below said tool for continuously isolating said first and second sealing members from said well bore pressure, including during any movement of said tool for positioning opposite said another segment.

* * * * *